US007545324B2

(12) United States Patent
Kalian et al.

(10) Patent No.: US 7,545,324 B2
(45) Date of Patent: Jun. 9, 2009

(54) PHASED ARRAY ANTENNA SYSTEMS AND METHODS

(75) Inventors: David Kalian, Redondo Beach, CA (US); Jane R. Felland, Palos Verdes Estates, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 12/042,574

(22) Filed: Mar. 5, 2008

(65) Prior Publication Data

US 2008/0150802 A1 Jun. 26, 2008

Related U.S. Application Data

(62) Division of application No. 11/263,145, filed on Oct. 31, 2005.

(51) Int. Cl.
*H01Q 3/00* (2006.01)

(52) U.S. Cl. ..... 342/372

(58) Field of Classification Search ..... 342/368, 342/371, 372

See application file for complete search history.

(56) References Cited

U.S. PATENT DOCUMENTS 5,084,708 A 1/1992 Champeau et al.
5,099,254 A * 3/1992 Tsukii et al. ..... 343/853
5,128,689 A 7/1992 Wong et al.
5,276,455 A 1/1994 Fitzsimmons et al.
5,278,574 A 1/1994 Zimmerman et al.
5,305,001 A 4/1994 Wong et al.
5,309,409 A 5/1994 Jones
5,414,433 A 5/1995 Chang
5,459,474 A * 10/1995 Mattioli et al. ..... 343/702
5,488,380 A 1/1996 Harvey et al.
5,541,607 A 7/1996 Reinhardt
5,565,878 A 10/1996 Lagerlof
5,663,683 A 9/1997 McCandless (Continued)

FOREIGN PATENT DOCUMENTS

EP 0 407 243 1/1991

(Continued)

OTHER PUBLICATIONS

U.S. Appl. No. 11/491,685, Kalian et al.

(Continued)

*Primary Examiner*—Gregory C Issing
(74) *Attorney, Agent, or Firm*—Haynes and Boone, LLP

(57) ABSTRACT

Systems and methods are disclosed herein providing an improved approach to phased array antenna communications. In one example, an antenna system includes a digital beamformer adapted to receive a plurality of input signals and selectively replicate and weight the input signals to provide a plurality of digital subarray signals. Digital to analog (D/A) converters convert the digital subarray signals to a plurality of composite analog subarray signals. Modules of a subarray are adapted to perform analog beamsteering on at least one of the composite analog subarray signals. In another example, a subarray of a phased array antenna may include a thermal cold plate, a plurality of feed/filter assemblies, a distribution board stacked on the thermal cold plate, and a plurality of modules adapted to perform analog beamsteering. The modules may be interconnected with each other through the distribution board and removably inserted into the distribution board.

18 Claims, 3 Drawing Sheets

U.S. PATENT DOCUMENTS

| | | | | |
|---|---|---|---|---|
| 5,907,304 | A | 5/1999 | Wilson et al. | |
| 6,184,827 | B1 | 2/2001 | Dendy et al. | |
| 6,184,832 | B1 | 2/2001 | Geyh et al. | |
| 6,469,671 | B1 * | 10/2002 | Pluymers et al. | 343/702 |
| 6,784,837 | B2 | 8/2004 | Revankar et al. | |
| 6,882,311 | B2 | 4/2005 | Walker et al. | |
| 6,946,992 | B2 | 9/2005 | McCleary et al. | |
| 6,972,716 | B2 | 12/2005 | Davis et al. | |
| 2002/0018023 | A1 | 2/2002 | Durham et al. | |
| 2003/0022395 | A1 | 1/2003 | Olds | |
| 2003/0206132 | A1 | 11/2003 | Phelan | |
| 2003/0206134 | A1 | 11/2003 | Lier et al. | |
| 2005/0052333 | A1 | 3/2005 | Rao et al. | |
| 2005/0093744 | A1 * | 5/2005 | Davis et al. | 342/368 |
| 2005/0168301 | A1 | 8/2005 | Carson | |
| 2005/0219137 | A1 | 10/2005 | Heisen et al. | |

FOREIGN PATENT DOCUMENTS

| | | | |
|---|---|---|---|
| JP | 2005038933 | * | 2/2005 |
| WO | WO 03/063299 | | 5/1994 |

OTHER PUBLICATIONS

Notification Of Transmittal of the International Search Report and the Written Opinion of the International Searching Authority mailed Jan. 23, 2007 for International Patent Application No. PCT/US2006/028940 (3 pages).

International Search report mailed Jan. 23, 2007 for International Patent Application No. PCT/US2006/028940 (6 pages).

Written Opinion of the International Searching Authority mailed Jan. 23, 2007 for International Patent Application No. PCT/US2006/028940 (10 pages).

International Search Report mailed Nov. 1, 2006 for International Patent Application No. PCT/US2006/028940 (8 pages).

* cited by examiner

PHASED ARRAY ANTENNA SYSTEMS AND METHODS

CROSS-REFERENCE TO RELATED APPLICATIONS

This application is a divisional application of U.S. patent application Ser. No. 11/263,145 filed Oct. 31, 2005, which is incorporated herein by reference in its entirety.

TECHNICAL FIELD

The present invention relates generally to antenna-based communication systems, and, more particularly, to phased array antenna systems.

BACKGROUND

In the field of antenna-based communication systems, there is an ongoing effort to provide ever-greater amounts of communication bandwidth to selected coverage areas. In this regard, existing communication systems often employ large antenna farms which may include multiple fixed antenna beams that are physically steered by reflector gimbals. Unfortunately, such systems can provide limited flexibility in directing the fixed antenna beams to desired coverage areas.

Other systems employ beam shaping techniques to optimize beam coverage over particular regions while minimizing beam emissions elsewhere. In one approach, analog beamforming techniques may be used in phased array antenna systems having limited numbers of antenna beams with high bandwidth provided by each beam. Other approaches may employ digital beamforming at each transmit or receive element of a phased array antenna system, thereby requiring numerous A/D and D/A converters and significant digital processing capacity.

In the case of analog beamforming, traditional phased array designs often focus on the integration of active electronics in a high density, low cost manner. However, such designs generally do not optimize cost and performance with regard to other considerations such as radiation shielding and thermal transport.

As set forth above, these various prior approaches fail to provide a desirable degree of end-to-end system design flexibility at moderate cost. Accordingly, there is a need for an improved approach to phased array antenna beamforming that provides a high degree of flexibility without excessive cost.

SUMMARY

In accordance with one embodiment of the present invention, an antenna system includes a digital beamformer adapted to receive a plurality of input signals and selectively replicate and weight the input signals to provide a plurality of digital subarray signals; a plurality of digital to analog (D/A) converters adapted to convert the digital subarray signals to a plurality of composite analog subarray signals; and a subarray comprising a plurality of modules adapted to perform analog beamsteering on at least one of the composite analog subarray signals. In another embodiment, a plurality of subarrays can be included.

In accordance with another embodiment of the present invention, an antenna system includes a subarray comprising a plurality of modules; a plurality of receive elements associated with the modules, wherein the modules are adapted to perform analog beamsteering on a plurality of signals received from the receive elements to provide a plurality of composite analog subarray signals; a plurality of analog to digital (A/D) converters adapted to convert the composite analog subarray signals to a plurality of digital subarray signals; a digital router adapted to map the digital subarray signals to a plurality of sets; and a digital beamformer adapted to receive the sets and perform phase and amplitude weighting and combining on the sets to selectively provide a plurality of output signals. In another embodiment, a plurality of subarrays can be included.

In accordance with another embodiment of the present invention, a method of providing signals for transmission from a phased array antenna system includes receiving a plurality of input signals; selectively replicating the input signals to provide a plurality of digital subarray signals; converting the digital subarray signals to a plurality of composite analog subarray signals; providing at least one of the composite analog subarray signals to a subarray; and performing analog beamsteering on the at least one of the composite analog subarray signals to provide a plurality of analog output signals.

In accordance with another embodiment of the present invention, a method of providing signals received by a phased array antenna system includes receiving a plurality of signals at a subarray; separating the received signals into beam ports; performing analog beamsteering on the received signals to provide a plurality of composite analog subarray signal; converting the composite analog subarray signals to a plurality of digital subarray signals; and selectively weighting and combining the digital subarray signals to provide a plurality of output signals using the digital subarray signals.

In accordance with another embodiment of the present invention, a subarray of a phased array antenna includes a thermal cold plate; a plurality of feed/filter assemblies mounted to the thermal cold plate; a distribution board stacked on the thermal cold plate; and a plurality of modules adapted to perform analog beamsteering, wherein the modules are interconnected with each other through the distribution board and removably inserted into the distribution board.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

Figure 1:
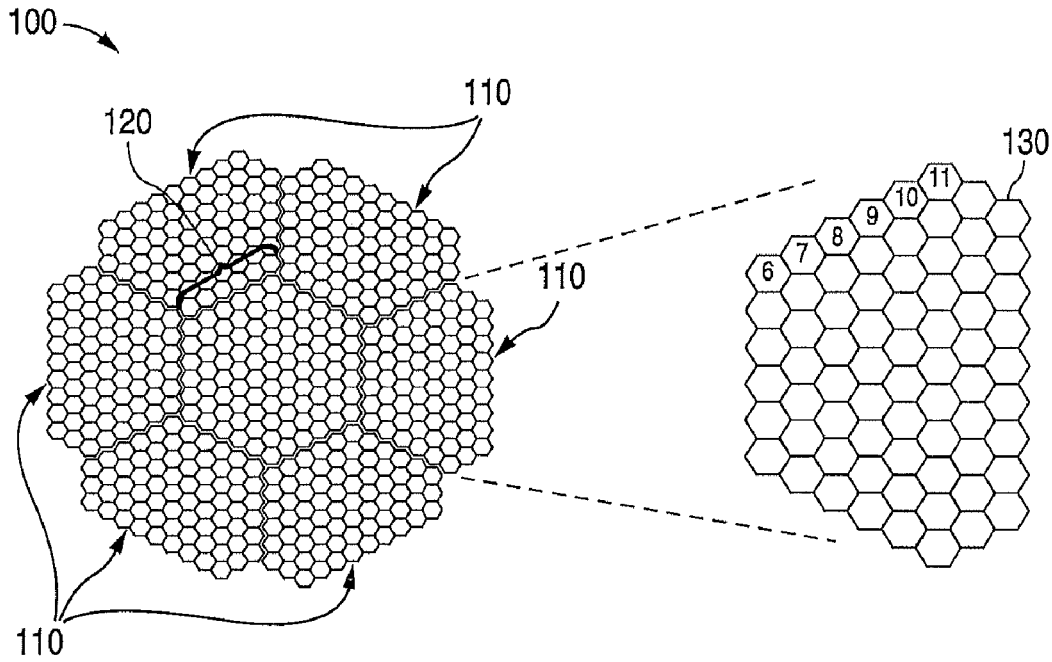
FIG. 1 shows an exemplary diagram illustrating an orientation of transmit elements of a phased antenna array in accordance with an embodiment of the present invention.

FIG. 1 shows an exemplary diagram illustrating an orientation of transmit elements of a phased antenna array 100 in accordance with an embodiment of the present invention. Phased antenna array 100 includes a plurality of transmit elements 130. In one embodiment, phased antenna array 100 may be implemented with an aperture of approximately 80" and with transmit elements 130.

Transmit elements 130 may be implemented as horns and arranged in a plurality of subarrays. In the embodiment illustrated in FIG. 1, six subarrays 110 are provided which encircle a seventh subarray 120. Each of subarrays 110 can be sized to be approximately 23" by 35" and can include 70 transmit elements 130. Subarray 120 can be implemented with an additional three rows of transmit elements 130 in comparison to subarray 110, thereby providing a total of 91 elements on subarray 120. As a result, the subarrays 110 and 120 can provide a combined total of 511 transmit elements 130.

Figure 2:
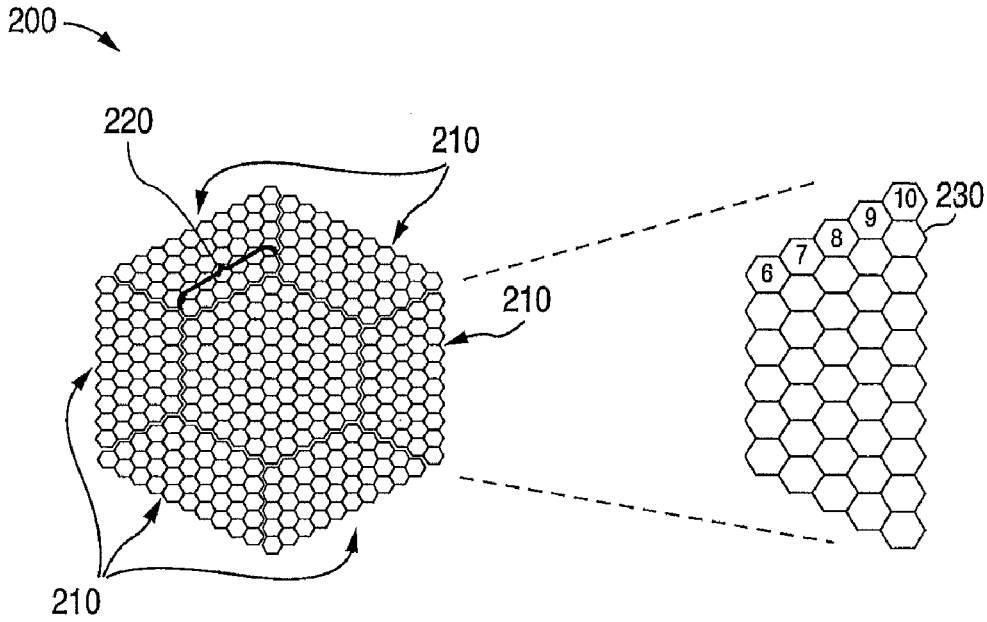
FIG. 2 shows an exemplary diagram illustrating an orientation of receive elements of a phased antenna array in accordance with an embodiment of the present invention.

FIG. 2 shows an exemplary diagram illustrating an orientation of receive elements of a phased antenna array 200 in accordance with an embodiment of the present invention. Phased antenna array 200 includes a plurality of receive elements 230. In one embodiment, phased antenna array 200 may be implemented with an aperture of approximately 53" and with receive elements 230.

Receive elements 230 may be implemented as horns and arranged in a plurality of subarrays. In the embodiment illustrated in FIG. 2, six subarrays 210 are provided which encircle a seventh subarray 220. Each of subarrays 210 can be sized to be approximately 14" by 28" and can include 40 receive elements 230. Subarray 220 can be implemented with two subarrays 210 with an additional row of 11 receive elements 230 in comparison to subarrays 210, thereby providing a total of 91 elements on subarray 220. As a result, the subarrays 210 and 220 can provide a combined total of 331 receive elements 230.

Figure 3:
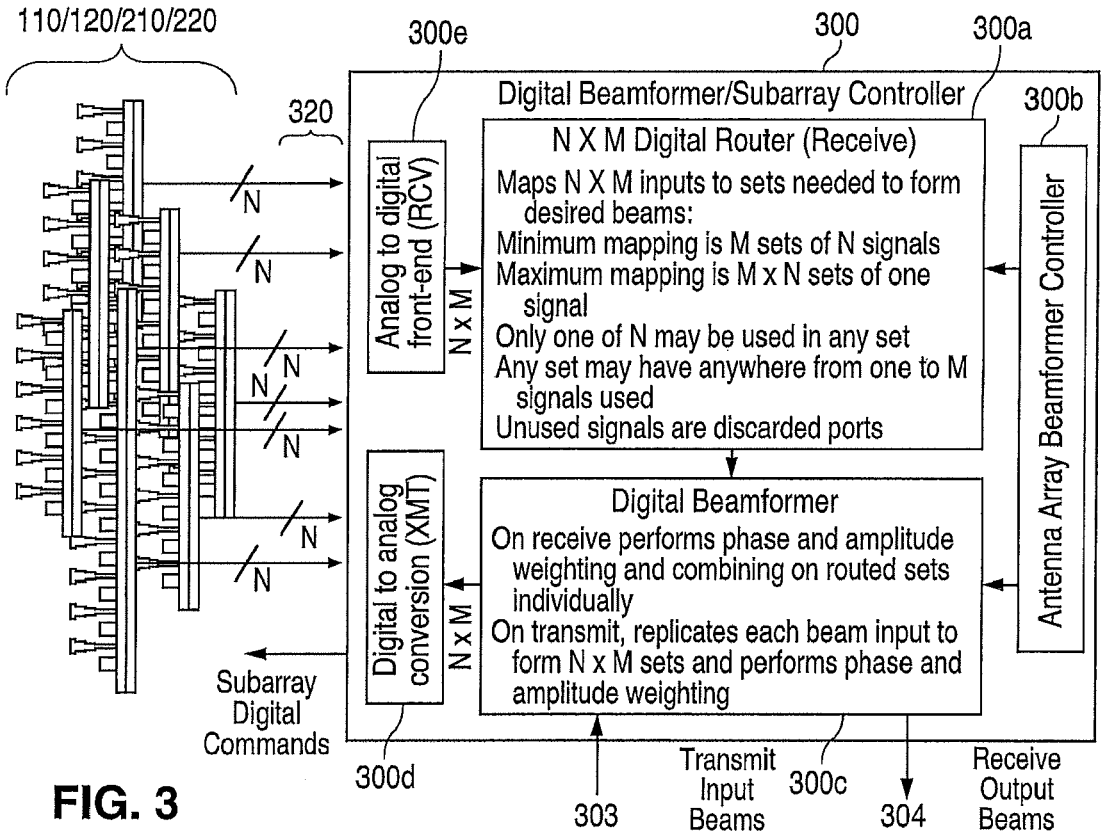
FIG. 3 shows an exemplary diagram illustrating a plurality of subarrays and a digital beamformer/subarray controller in accordance with an embodiment of the present invention.

FIG. 3 shows an exemplary diagram illustrating a plurality of subarrays 110, 120, 210, and/or 220, and a digital beamformer/subarray controller 300 in accordance with an embodiment of the present invention.

Up to N (for example, 16) signals can be transmitted and/or received between M (for example, 7) subarrays 110/120/210/220 and digital beamformer/subarray controller 300 over each of busses 320. As such, each of busses 320 may provide up to N lines supporting N signals. It will be appreciated that in embodiments supporting signal transmission from phased antenna array 100, subarrays 110 and 120 can be used. Similarly, in embodiments supporting signal reception from phased antenna array 200, subarrays 210 and 220 can be used.

In various embodiments, digital beamformer/subarray controller 300 can be implemented in accordance with one or more general purpose or specialized processors, and associated converters. For example, digital beamformer/subarray controller 300 may include a digital router 300*a*, antenna array beamformer controller 300*b*, digital beamformer 300*c*, digital to analog (D/A) converters 300*d*, and analog to digital converters (A/D) 300*e*. As illustrated, digital router 300*a* and digital beamformer 300*c* can be provided under the control of antenna array beamformer controller 300*b*. As also illustrated, digital beamformer/subarray controller 300 can provide digital commands to subarrays 110/120/210/220 as desired.

RF signals received from subarrays 210 and 220 over busses 320 can be provided to A/D converters 300*e* which convert the received analog signals into digital signals and provide the digital signals to digital router 300*a*. As indicated in FIG. 3, digital router 300*a* can be implemented to map N×M inputs to sets of signals used to form composite signals (i.e., beams) as desired. In one embodiment, the minimum mapping is M sets of N signals, the maximum mapping is M×N sets of one signal, only one of N is used in any set, and any set may have anywhere from one to M signals used. As indicated in FIG. 3, unused signals may be discarded.

The mapped sets of signals can be provided to digital beamformer 300*c* where they are phase and amplitude weighted and individually combined as may be desired for particular applications. The digitally beamformed signals can then be provided to output ports 304.

Signals to be transmitted from subarrays 110 and 120 can be provided to digital beamformer 300*c* through input ports 303. Digital beamformer 300*c* can be implemented to replicate each input signal and map the signals to N×M sets of signals and perform phase and amplitude weighting and combine individual signals to form N×M signals. The resulting digital signals are then provided to D/A converters 300*d* which provide analog signals to subarrays 110 and 120.

Figure 4:
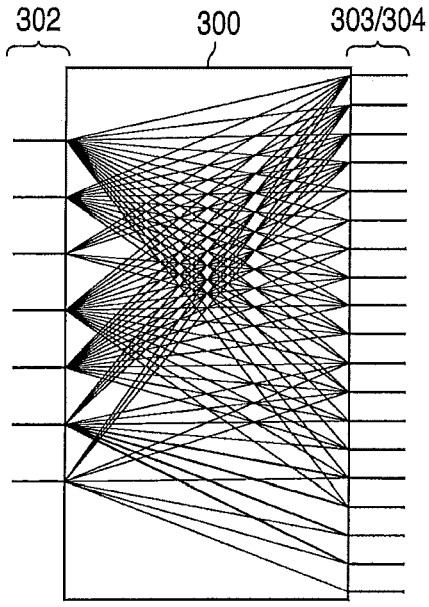
FIG. 4 shows an exemplary diagram illustrating a plurality of subarray ports interfaced with a digital beamformer/subarray controller in accordance with an embodiment of the present invention.

FIG. 4 shows an exemplary diagram illustrating functional operation of digital beamformer/subarray controller 300 in accordance with an embodiment of the present invention.

For signal transmission from subarrays 110 and 120, a plurality of input signals provided to input ports 303 can be selectively digitally beamformed and provided to one or more of subarrays 110 and 120 through output ports 302 connected to busses 320. With regard to signal reception, a plurality of RF signals received at ports 302 over busses 320 can be selectively converted into digital signals, routed, digitally beamformed, and provided to output ports 304. It will be appreciated that these various functions can be provided by the components of digital beamformer/subarray controller 300 as previously discussed with respect to FIG. 3.

Figure 5:
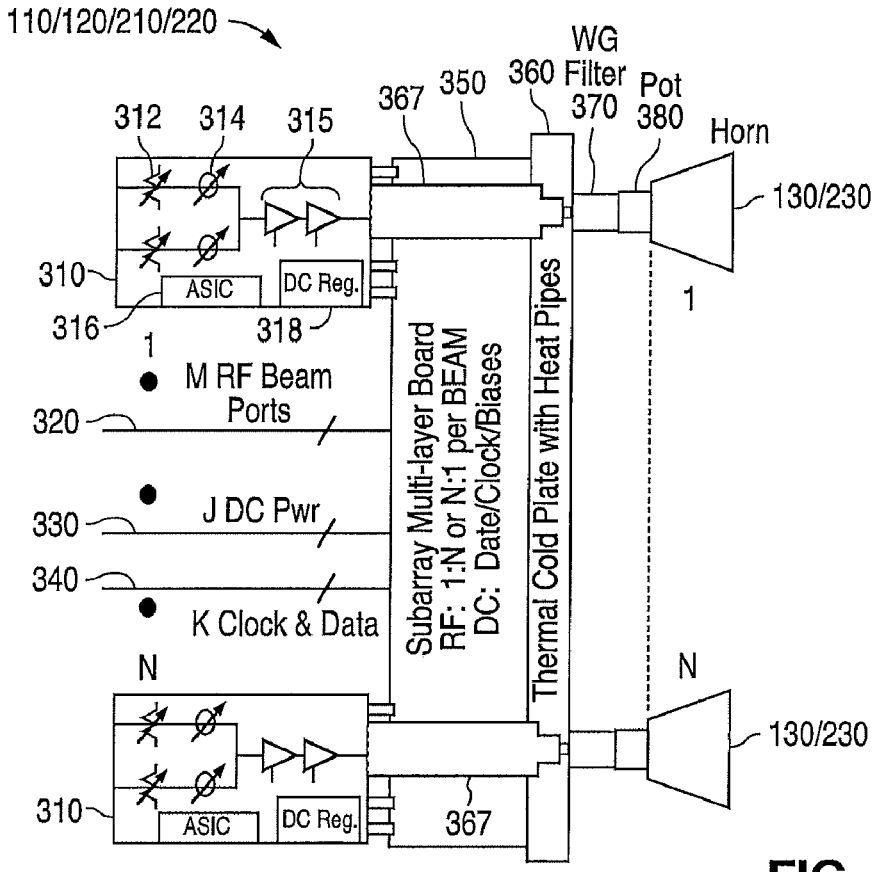
FIG. 5 shows an exemplary diagram illustrating components associated with a subarray in accordance with an embodiment of the present invention.

FIG. 5 shows an exemplary diagram illustrating components associated with one of subarrays 110, 120, 210, or 220. A plurality of modules 310 are removably installed on a distribution board 350, with each module 310 associated with a transmit element 130 or receive element 230. A thermal cold plate 360 with heat pipes (see FIG. 6) is affixed to distribution board 350 for providing cooling. In particular, thermal cold plate 360 can be implemented to provide thermal transport, current return, structural support, and shielding for its associated subarray. Such features can be supported by the stacking of components on thermal cold plate 360 as illustrated in FIG. 5 (and further illustrated in FIG. 6). As illustrated, one or more DC power sources 330 and a plurality of clock/data input signals 340 can also be provided to distribution board 350.

Bus 320 carrying composite analog subarray signals from one of ports 302 of digital beamformer 300 is coupled to distribution board 350. Subarrays 110, 120, 210, and 220 can be modular and be connected directly to their associated busses 320, allowing flexibility in bus packaging. Advantageously, the composite analog subarray signals carried by bus 320 can be provided to modules 310 through distribution board 350. As a result, bus 320 need not be individually coupled to each of modules 310.

Each module 310 can be provided with appropriate circuitry for performing analog beamsteering and amplification of one or more of the analog signals received from bus 320. Specifically, each module 310 can include phase shifters 312, amplitude scalers 314, amplifiers 315, an ASIC (i.e. an application-specific integrated circuit) for controlling operation of module 310, a DC regulator 318, and a polarization control circuit (not shown). In addition, it will be appreciated that the various components of module 310 described herein may be combined into composite components, such as mixed signal chips.

Modules 310 can be implemented to be removably inserted into distribution board 350, cold plate 360, and an RF waveguide 367 to feed such components simultaneously. For example, in one embodiment, all module 310 interfacing can be provided in one plane with no blockage from the rear of the associated subarray. As a result, modules 310 can be easily replaced without disassembly of their associated subarrays. It will be appreciated that such improved module 310 access can reduce integration and related test costs. It will also be appreciated that cutouts in distribution board 350 can support a direct RF path from modules 310 to send/receive elements 130/230 and can provide a direct thermal path to thermal cold plate 360.

An analog beamformed output signal can be provided by each module 310 to an associated transmit element 130 through distribution board 350 and cold plate 360 through the associated RF waveguide 367. As illustrated, the analog output signal can be passed through distribution board 350 and thermal cold plate 360 to a waveguide filter 370, polarizer 380, and transmit element 130 implemented as a horn.

Figure 6:
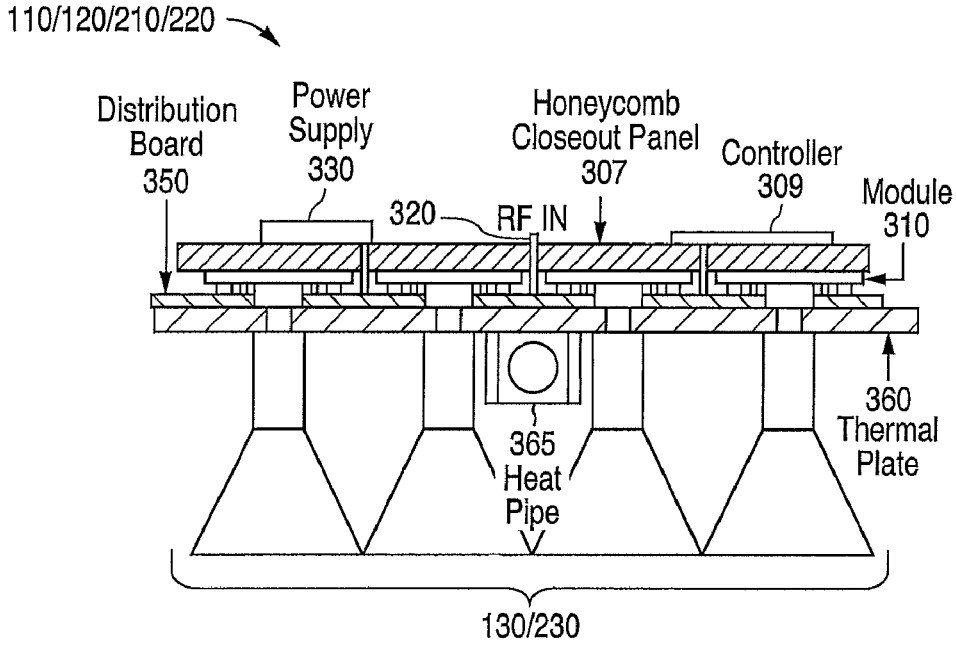
FIG. 6 shows an exemplary diagram illustrating a cross-sectional side view of a portion of a subarray in accordance with an embodiment of the present invention.

FIG. 6 shows an exemplary diagram illustrating a cross-sectional side view of a portion of one of subarrays 110, 120, 210, or 220 in accordance with an embodiment of the present invention. In particular, FIG. 6 provides further detail as to the placement and orientation of various components in relation to multilayer distribution board 350 and thermal cold plate 360.

Distribution board 350 (i.e. distribution board or RF board) may provide various functionality associated with a backbone, jumpers, stripline, dividers, and coax connections. Distribution board 350 can support the routing and RF combining/dividing of signals in one piece, thereby permitting parts reduction. As previously discussed with regard to FIG. 5, thermal cold plate 360 and one or more associated heat pipes 365 are also provided. As illustrated, a closeout panel 307 can be affixed to a back side of modules 310.

Modules 310 are removably installed in distribution board 350 and interconnected with each other through distribution board 350. Accordingly, individual modules 310 may be removed without breaking connections of other modules 310, distribution board 350, or cold plate 360. As previously discussed, each of modules 310 is associated with one of transmit elements 130 or receive elements 230, and can provide analog beamforming of signals received through bus 320. A controller 309 is provided for coordinating the analog beamforming operations of modules 310. Each of modules can also provide support for power amp (PAM) and receive amp (RAM) functions.

The operation of the various components of an antenna system in accordance with an embodiment of the present invention system will now be discussed with respect to the following examples. For transmit operations, a plurality of digital or analog input signals are initially provided to ports 304 of digital beamformer 300*c*. In the case of analog input signals, digital beamformer 300*c* may initially convert the analog signals into digital signals. The digital signals are then selectively replicated to sets, then weighted, and then combined by digital beamformer 300 to provide a plurality of digital subarray signals. The digital subarray signals are then converted to a plurality of composite analog subarray signals.

Individual RF signals are formed for each subarray 110 and 120 for each beam supported by that subarray. Alternatively, individual digital signals may be created and converted to analog signals locally at each subarray 110 and 120 by controller 309. The composite analog subarray signals are provided to distribution boards 350 of subarrays 110 and 120 through ports 302 and busses 320. At the subarray level, the composite analog subarray signals are separated into individual analog signals with one analog signal for each module 310 (1 to N signals as illustrated in FIG. 5) and provided to modules 310 where analog beamsteering is provided at each module 310 under the control of controller 309. Analog output signals resulting from the analog beamsteering at modules 310 can be combined into one composite signal per polarization port, polarization controlled, amplified by amplifiers 315, and transmitted through transmit elements 130.

For receive operations, a plurality of analog RF signals can be received by receive elements 230 of one or more of subarrays 210 and 220. Modules 310 associated with each receive element 230 can split the signals into the number of beam ports supported and perform analog beamforming on the received signals under control of controller 309. The beam port signals from each module 310 are then combined to collectively provide composite analog subarray signals with one analog signal per beam port output to bus 320. Alternately, the received analog signals may be converted into digital signals at subarrays 210 and 220 before they are provided to digital beamformer/subarray controller 300.

Composite analog subarray signals received from each of subarrays 210 and 220 can be received at ports 302 of digital beamformer 302. The composite analog subarray signals can then be converted into digital subarray signals by A/D converters 300*e* and processed by digital router 300*a* and digital beamformer 300*c* as previously described to selectively provide a plurality of digital output signals. The resulting digital output signals can be sent from ports 304 as digital output signals or converted into analog output signals prior to being sent from ports 304.

In view of the foregoing, it will be appreciated that a hybrid analog-digital approach to beamforming can be provided in accordance with various embodiments of the present invention. In various embodiments, this approach provides flexibility in providing the signals to the subarrays. The analog subarrays are effectively independently steerable phased array antennas with a minimum beamwidth no larger than the maximum useful to the system. Because digital beamformer/subarray controller 300 can selectively route and/or digitally beamform appropriate signals to and from the various subarrays, it provides maximal flexibility. Further, the implementation of digital beamforming on aggregate subarray signals versus module/element signals allows maximum digital bandwidth with minimum DC power penalty. The subarrays can be implemented to be interconnectable in a variety of layouts resulting in flexibility in designing total antenna apertures. Moreover, the approach can be applied to both receive and transmit arrays, as well as diplexed transmit and receive array antennas.

It will further be appreciated that the interconnection of modules 310 through distribution board 350 and the removable implementation of modules 310 as discussed herein can advantageously permit modules 310 to be easily replaced without disassembly of their associated subarrays. In addition, the stackup of components on thermal cold plate 360 as illustrated in FIGS. 5 and 6 can beneficially permit thermal cold plate 360 to provide thermal transport, current return, structural support, and shielding for its associated subarray.

Embodiments described above illustrate but do not limit the invention. For example, it will be appreciated that, where appropriate, principles applied herein to the transmission of signals can be applied to the reception of signals, and vice versa. It should also be understood that numerous modifications and variations are possible in accordance with the principles of the present invention. Accordingly, the scope of the invention is defined only by the following claims.

We claim:

1. A subarray of an antenna system, the subarray comprising:

a plurality of transmit elements;

a thermal cold plate;

a distribution board stacked on the thermal cold plate and adapted to distribute a plurality of analog signals;

a port in communication with the distribution board and adapted to pass to the distribution board a composite analog subarray signal comprising the analog signals;

a plurality of waveguides extended through the distribution board and the thermal cold plate; and a plurality of modules in communication with the transmit elements through the waveguides and adapted to receive the analog signals through the distribution board and perform analog beamsteering on the analog signals to provide output signals to the transmit elements through the waveguides, wherein the modules are interconnected with each other through the distribution board and removably inserted into the distribution board, wherein the modules are adapted to be removed from the distribution board without disassembly of the distribution board and without disassembly of the transmit elements.

2. The subarray of claim 1, further comprising a plurality of feed/filter assemblies mounted to the thermal cold plate.

3. The subarray of claim 1, further comprising a subarray controller adapted to convert a digital subarray input signal to the composite analog subarray signal.

4. The subarray of claim 1, wherein the antenna system is a phased array antenna system.

5. A subarray of an antenna system, the subarray comprising:

a plurality of receive elements;

a thermal cold plate;

a distribution board stacked on the thermal cold plate and adapted to distribute a plurality of analog signals;

a port in communication with the distribution board and adapted to receive from the distribution board a composite analog subarray signal comprising a plurality of analog signals;

a plurality of waveguides extended through the distribution board and the thermal cold plate; and a plurality of modules in communication with the receive elements through the waveguides and adapted to perform analog beamsteering on a plurality of signals received from the receive elements through the waveguides to provide the analog signals to the distribution board, wherein the modules are interconnected with each other through the distribution board and removably inserted into the distribution board, wherein the modules are adapted to be removed from the distribution board without disassembly of the distribution board and without disassembly of the receive elements.

6. The subarray of claim 5, further comprising a plurality of feed/filter assemblies mounted to the thermal cold plate.

7. The subarray of claim 5, further comprising a subarray controller adapted to convert the composite analog subarray signal to a digital output signal for transmission to a digital beamformer.

8. The subarray of claim 5, further comprising a heat pipe associated with the thermal cold plate.

9. The subarray of claim 5, wherein the antenna system is a phased array antenna system.

10. A method of providing signals for transmission from an antenna system, the method comprising:

receiving at a subarray a composite analog subarray signal comprising a plurality of analog signals, the subarray comprising:

a plurality of transmit elements, a thermal cold plate, a distribution board stacked on the thermal cold plate, a plurality of waveguides extended through the distribution board and the thermal cold plate, and a plurality of modules in communication with the transmit elements through the waveguides, wherein the modules are interconnected with each other through the distribution board and removably inserted into the distribution board, wherein the modules are adapted to be removed from the distribution board without disassembly of the distribution board and without disassembly of the transmit elements;

separating the composite analog subarray signal into the analog signals;

distributing the analog signals to the modules through the distribution board;

performing analog beamsteering on the analog signals to provide a plurality of analog output signals using the modules; and providing the analog output signals from the modules to the transmit elements through the waveguides.

11. The method of claim 10, further comprising transmitting the analog output signals from the subarray.

12. The method of claim 10, wherein the subarray is a first subarray and the composite analog subarray signal is a first analog subarray signal, the method further comprising receiving at least a second composite analog subarray signal at a second subarray.

13. The method of claim 10, wherein the analog beamsteering comprises selectively adjusting a phase and amplitude of each of the analog output signals.

14. The method of claim 10, wherein the antenna system is a phased array antenna system.

15. A method of providing signals received by an antenna system, the method comprising:

receiving a plurality of signals at a subarray, the subarray comprising:

a plurality of receive elements, a thermal cold plate, a distribution board stacked on the thermal cold plate, a plurality of waveguides extended through the distribution board and the thermal cold plate, and a plurality of modules in communication with the receive elements through the waveguides, wherein the modules are interconnected with each other through the distribution board and removably inserted into the distribution board, wherein the modules are adapted to be removed from the distribution board without disassembly of the distribution board and without disassembly of the receive elements;

receiving the received signals at the modules from the receive elements through the waveguides;

performing analog beamsteering on the received signals to provide a plurality of analog signals using the modules;

distributing the analog signals from the modules through the distribution board; and combining the distributed analog signals to provide a composite analog subarray signal comprising the analog signals.

16. The method of claim 15, wherein the plurality of received signals are received at a plurality of subarrays.

17. The method of claim 15, further comprising converting the composite analog subarray signal to a digital signal for transmission to a digital beamformer.

18. The method of claim 15, wherein the antenna system is a phased array antenna system.

* * * * *